US008055505B2

(12) United States Patent
Tachibana et al.

(10) Patent No.: US 8,055,505 B2
(45) Date of Patent: Nov. 8, 2011

(54) AUDIO CONTENT DIGITAL WATERMARK DETECTION

(75) Inventors: Ryuki Tachibana, Yokohama (JP); Norishige Morimoto, Tokyo (JP)

(73) Assignee: International Business Machines Corporation, Armonk, NY (US)

( * ) Notice: Subject to any disclaimer, the term of this patent is extended or adjusted under 35 U.S.C. 154(b) by 669 days.

(21) Appl. No.: 12/140,750

(22) Filed: Jun. 17, 2008

(65) Prior Publication Data

US 2009/0022361 A1 Jan. 22, 2009

(51) Int. Cl.
*G10L 21/00* (2006.01)

(52) U.S. Cl. ..... 704/273; 704/500; 342/387; 380/201; 380/236; 382/100; 713/176

(58) Field of Classification Search ..... 380/236, 380/201; 713/176; 704/273, 500; 342/387; 382/100

See application file for complete search history.

(56) References Cited

U.S. PATENT DOCUMENTS 4,423,419 A * 12/1983 Johannessen ..... 342/387
5,303,294 A * 4/1994 Kimoto et al. ..... 380/201
7,299,189 B1 * 11/2007 Sato ..... 704/500
2001/0029580 A1 * 10/2001 Moskowitz ..... 713/176
2002/0009209 A1 * 1/2002 Inoue et al. ..... 382/100
2002/0013903 A1 * 1/2002 Le Floch ..... 713/176
2003/0068043 A1 * 4/2003 Tam et al. ..... 380/236
2004/0059918 A1 * 3/2004 Xu ..... 713/176
2004/0133427 A1 * 7/2004 Alattar et al. ..... 704/273

* cited by examiner

*Primary Examiner* — Richemond Dorvil
*Assistant Examiner* — Michael Colucci
(74) *Attorney, Agent, or Firm* — Michael J. Buchenhorner; Vazken Alexanian

(57) ABSTRACT

Digital watermark detection apparatus including detection units which calculate detected values of watermark signals by use of keys for PCM data of channels of audio content, a plurality of units which add the detected values corresponding to each of the channels and each of the keys for each possible combination of the respective channels and the respective keys, and a unit which selects and outputs one adding result from the respective adding results by the plurality of detected value adding units. Moreover, it includes units which accumulate the detected values in accumulation cycles different from one another to restore messages embedded as digital watermarks from the accumulated detected values, and perform boundary detection of the audio contents to detect the audio contents in which the digital watermarks are embedded, and a detection result output unit which synthesizes and outputs respective processing results by the message restoration units.

18 Claims, 11 Drawing Sheets

AUDIO CONTENT DIGITAL WATERMARK DETECTION

FIELD OF THE INVENTION

The present invention relates to embedding and detection of a digital watermark for audio content, and particularly to an embedding method and detection method of a digital watermark high in robustness to deterioration of the content.

BACKGROUND OF THE INVENTION

Nowadays, as means for preventing secondary use of audio contents converted into digital data, such as illicit copy and modification thereof, a digital watermark technology for embedding specific information in the audio contents is widely utilized.

In the digital watermark technology, the same information (watermark information) is repeatedly embedded in a plurality of spots of a piece of audio content. Then, when detecting the watermark information, values detected from the respective spots embedding the watermark information are accumulated in a buffer, intensified together, and then subjected to processing such as error correction. Thereafter, a detection result is outputted.

As a general technique of the digital watermark technology for embedding watermark information in audio content, a technique is employed, in which a pseudo random number sequence is generated by use of data called a key, a frequency component in data of the audio contents is processed by use of this pseudo random number sequence to create a signal (watermark signal) containing desired watermark information, and the signal is added to the data of the original audio content. Then, when detecting the watermark information, a technique is employed, in which the frequency component of the data of the audio contents is processed by use of a pseudorandom number sequence generated by the same key, detected values as a result of the processing are accumulated in the buffer, then the watermark signal is extracted from the accumulated values, and an embedded message (watermark information) is decoded.

The following documents are considered:

[Patent Document 1] Japanese Patent Laid-Open No. H11 (1999)-341452

[Patent Document 2] Japanese Patent Laid-Open No. 2002-320085

A length (time) of the accumulation of the detected values when detecting the watermark information is usually one type of fixed length. For example, a detection apparatus is designed such that 30 seconds are set as a cycle of the accumulation and the detection result of the watermark signal is outputted for every 30 seconds. Moreover, in a digital watermark technology for digital contents of a motion picture, a technique of varying the length of the accumulation of detected values when detecting watermark information is proposed (for example, refer to Patent Document 1). In this technology, watermark signals are weakly embedded so as not to deteriorate quality of the motion picture, and at the time of detection of the watermark information, the detected values are accumulated in a buffer until the detected values reach intensity sufficient for detecting the watermark information.

Moreover, in audio contents, there is one composed of a plurality of channels, such as one recorded in stereo. When the digital watermark is embedded in such audio contents, in general, one pseudo random number sequence is generated by use of one key, audio data in the respective channels is processed by use of this one pseudo random number, and thus the embedding is performed. Specifically, the same watermark signals are embedded in the audio data in the respective channels. In this case, when detecting the digital watermark, a technique is employed, in which the watermark signals are detected from the audio data in the respective channels and are synthesized, and an embedded message (watermark information) is decoded. When the digital watermarks are embedded in the respective channels, detected values from the respective channels highly correlate with one another, and accordingly, a component of the message in the detected values is intensified, thus facilitating the message to be restored. Furthermore, in the case of using the digital watermark technology for the purpose of ensuring security, a technique is proposed, in which a plurality of digital watermarks are created by use of different keys depending on features of contents and a passage of time thereof and are embedded in signals to be processed in order to enhance maintainability (for example, refer to Patent Document 2).

Meanwhile, audio contents converted into digital data are in themselves delivered through a broadcast and a network, or distributed by being recorded in a variety of recording media. In addition, audio contents are provided by being processed in various ways such as used as a piece of BGM (background music) of other contents and a jingle for a program. Hence, there are also audio contents which are extremely short in terms of time (for example, approximately two seconds), ones which are deteriorated due to superposition of another sound thereon, and the like.

Considering the existence of audio contents which are short in terms of time, it is preferable that the embedding of a digital watermark in audio contents also be performed for a short time span of the audio contents. On the other hand, in order to detect a digital watermark from audio contents, which are subjected to the superposition of another sound thereon and then deteriorated by being used as a piece of BGM and the like, it is necessary that detected values from the audio contents for a somewhat long time (for example, approximately 30 seconds) be accumulated (specifically, samples of the detected values be increased) and the watermark signal be intensified and then extracted.

However, when an accumulation cycle of the detected values is prolonged, the digital watermark embedded in the short audio contents cannot be detected. For example, even when attempting to detect a digital watermark from audio contents of approximately two seconds in the accumulation cycle set at 30 seconds, detected values, which come from sounds other than the intended audio contents, are included in the accumulated detected values for approximately 28 (=30−2) seconds. Accordingly, the message (watermark information) embedded in the audio contents cannot be correctly detected.

The above-mentioned prior art, in which the accumulation cycle of the detected values varies, has an aspect to intensify and combine the weakly embedded watermark signals by accumulating the signals until the signals reach the intensity sufficient for detecting the watermark information. In the prior art, to set an appropriate accumulation cycle for detecting the watermark information individually from the short audio contents and the deteriorated audio contents is left out of consideration.

If audio contents are a stereo-recorded audio composition or the like, the same watermark signals are embedded in the audio data in the respective channels, as mentioned above. When the digital watermark is detected, the watermark signals are detected from the audio data in the respective channels and synthesized, and then the message is restored.

However, when such audio contents are used as a piece of BGM of a narration, a sound of the narration superimposed on the audio contents has a signal analogous to a monaural one in many cases, and the correlation between the audio data of the narration in the respective channels is high. Hence, when the detected values from the respective channels are synthesized together to intensify components of the highly correlated message, components of the narration sounds are also intensified. Accordingly, it is difficult to distinguish between the message components and the noise components (narration sounds) in the detected values, thereby making it difficult to restore the message.

In order to detect the watermark signals in such a case, it is necessary to set a threshold value (a degree of correlation) for identifying the components of the watermark signals among the detected values, to a large one. However, when this threshold value is set to a large one, a much higher correlation between the watermark signals in the respective channels will be required in order to detect the digital watermark, and robustness to the deterioration of the digital watermark will be reduced.

The above-mentioned prior art which creates the watermark signals by use of the different keys in response to the features of the contents and the passage of time and embeds the created watermark signals in the signals to be processed does not consider the deterioration when a sound analogous to a monaural one, such as a narration, is superimposed on the audio contents having a plurality of channels though the prior art embeds the different watermark signals in response to the features of the contents and the passage of time. Hence, when the digital watermarks are embedded in the audio data in the respective channels, the same watermark signals using one key are likewise embedded in the audio data in the respective channels. Accordingly, the above-described problem can not be solved.

SUMMARY OF THE INVENTION

To solve the above-described problems, it is an aspect of the present invention to improve robustness of a digital watermark embedded in audio contents which are to be processed in various ways.

Moreover, it is another aspect of the present invention to provide a method and a system for appropriately detecting the digital watermark particularly from audio contents short in terms of time or deteriorated audio contents.

Furthermore, it is still another aspect of the present invention to provide a method and a system for embedding and detecting a digital watermark particularly having a strong robustness to deterioration due to superposition of another sound on audio contents.

In order to achieve the above-described aspects, the present invention is realized as a digital watermark detection apparatus constituted as below. A digital watermark detection apparatus includes: a plurality of watermark signal detection units for individually calculating, for PCM data in the respective channels of audio contents, detected values which are correlation coefficients between frequency components of the PCM data and pseudo random number sequences generated by a plurality of keys used to embed the digital watermark; a plurality of detected value adding units for adding the detected values calculated by the plurality of watermark signal detection units and corresponding to the respective channels and the respective keys for each possible combination of the respective channels and the respective keys; a comparison/selection unit for receiving and comparing the respective results of the addition by the plurality of detected value adding units with one another, and selecting and outputting one result of the addition; and a message restoration unit for restoring a message embedded as a digital watermark based on the result of the addition of the detected values, the result being outputted from the comparison/selection unit, and detecting the audio contents in which the digital watermark is embedded.

According to the present invention, the robustness of the digital watermarks embedded in audio contents processed in various ways can be improved. Specifically, a method and system for appropriately detecting a digital watermark particularly from audio contents short in terms of time or deteriorated audio contents can be provided. Moreover, a method and system embedding and detecting a digital watermark particularly having a strong robustness to deterioration due to superposition of another sound on audio contents.

BRIEF DESCRIPTION OF THE DRAWINGS

For a more complete understanding of the present invention and the advantage thereof, reference is now made to the following description taken in conjunction with the accompanying drawings, in which.

DETAILED DESCRIPTION OF THE INVENTION

Figure 1:
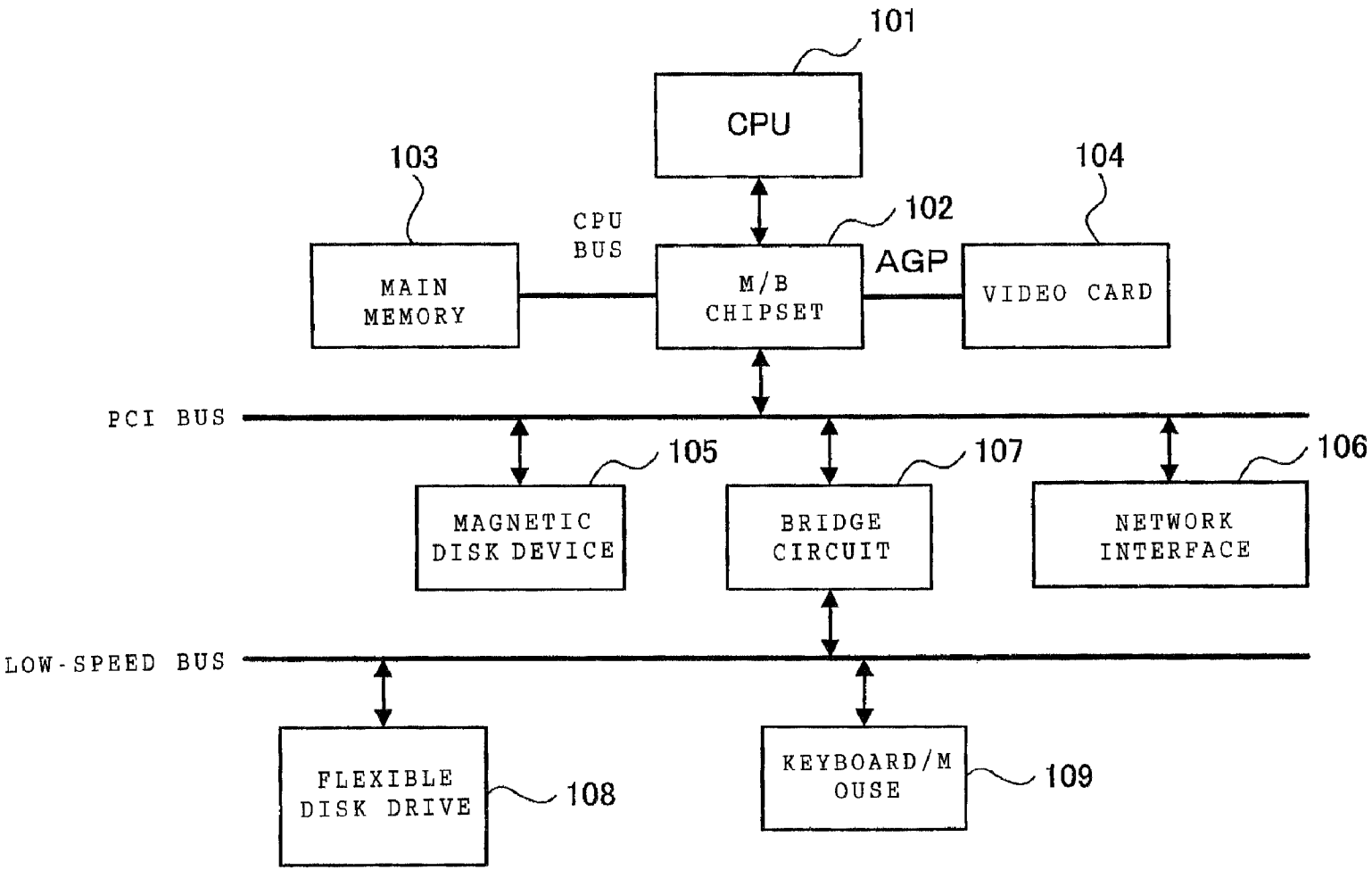
FIG. 1 is a view schematically showing an example of a hardware configuration of a computer apparatus suitable for realizing apparatus in Embodiments 1 and 2.

The present invention provides systems, apparatus and methods to improve robustness of a digital watermark embedded in audio contents which are to be processed in various ways. Moreover, the present invention provides a method and a system for appropriately detecting the digital watermark particularly from audio contents short in terms of time or deteriorated audio contents. Furthermore, the present invention provides a method and a system for embedding and detecting a digital watermark particularly having a strong robustness to deterioration due to superposition of another sound on audio contents.

In an example embodiment, the present invention is realized as a digital watermark detection apparatus. A digital watermark detection apparatus includes: a plurality of watermark signal detection units for individually calculating, for PCM data in the respective channels of audio contents, detected values which are correlation coefficients between frequency components of the PCM data and pseudo random number sequences generated by a plurality of keys used to embed the digital watermark; a plurality of detected value adding units for adding the detected values calculated by the plurality of watermark signal detection units and corresponding to the respective channels and the respective keys for each possible combination of the respective channels and the respective keys; a comparison/selection unit for receiving and comparing the respective results of the addition by the plurality of detected value adding units with one another, and selecting and outputting one result of the addition; and a message restoration unit for restoring a message embedded as a digital watermark based on the result of the addition of the detected values, the result being outputted from the comparison/selection unit, and detecting the audio contents in which the digital watermark is embedded.

Here, more preferably, in the plurality of detected value adding units, a detected value adding unit for outputting the detected value calculated by one of the watermark signal detection units as is, without adding the detected value to detected values calculated by the other watermark signal detection units, is included.

Moreover, from the results of the addition by the plurality of detected value adding units, the comparison/selection unit selects the following as the added results to be outputted.

One in which a sum of absolute values of the detected values is maximum.

One in which a sum of squares of the detected values is the maximum.

One in which the number of bits, an error has occurred therein, is minimum after performing error correction for the results of the addition.

One in which a signal-to-noise ratio (SNR) is maximum found as a result of performing error correction for the results of the addition and calculating the SNRs by obtaining correct symbols of individual bits.

Furthermore, a configuration can be adopted, in which orders of processing by the above-mentioned comparison/selection unit and processing by the message restoration unit are changed. In this case, a plurality of message restoration units are prepared, and the plurality of message restoration units individually receive the results of the addition by a plurality of detected value adding units, and restore the messages embedded as the digital watermarks. Then, the comparison/selection unit receives and compares results of restoring the messages by the plurality of message restoration units, and selects and outputs a series of messages.

Moreover, another embodiment of the present invention achieving the above-described aspects is realized as a digital watermark detection apparatus constituted as below. The digital watermark detection apparatus includes: a watermark signal detection unit for calculating a detected value which is a correlation coefficient between a frequency component of PCM data of audio contents and a pseudo random number sequence generated by a key used to embed the digital watermark; a plurality of message restoration units for accumulating the detected value calculated by the watermark signal detection unit in accumulation cycles different from one another, restoring the message embedded as the digital watermark from the accumulated detected values, and moreover, performing boundary detections of the audio contents, and detecting the audio contents in which the digital watermark is embedded; and a detection result output unit for receiving the respective processing results by the plurality of message restoration units, and synthesizing and outputting detection results of the audio contents in the respective processing results, with the digital watermarks being embedded in the audio contents.

Here, in more detail, when the audio contents in which the digital watermark is embedded are detected by any of the message restoration units, the detection result output unit determines that the detected audio contents are the ones in which the digital watermark is embedded, and determines a portion where the audio contents in which the digital watermark is embedded are not detected by any of the message restoration units as audio contents in which the digital watermark is not embedded. Moreover, when the audio contents in which the digital watermarks are embedded are detected by the plurality of message restoration units, a detection result by the message restoration unit of which accumulation cycle is shorter is prioritized. Furthermore, when the audio contents in which the digital watermark is embedded is detected by a predetermined one of the message restoration units, a detection result by the message restoration unit is outputted without waiting for detections by the other message restoration units of which accumulation cycles are longer than that of the message restoration unit.

Moreover, still another embodiment of the present invention achieving the above-described aspects is realized as a digital watermark detection method as below for detecting a digital watermark embedded in audio contents by a computer. Specifically, the digital watermark detection method includes: a first step of individually calculating, for PCM data in the respective channels of audio contents, detected values which are correlation coefficients between frequency components of the PCM data and pseudo random number sequences generated by a plurality of keys used to embed the digital watermark, and of storing the calculated detected values in storing means; a second step of adding the calculated detected values corresponding to the respective channels and the respective keys for each possible combination of the respective channels and the respective keys, and of storing the added detected values in the storing means; a third step of receiving and comparing the respective results of the addition for each combination of the respective channels and the respective keys, and of selecting and outputting one result of the addition; and a fourth step of restoring a message embedded as the digital watermark based on the selected and outputted result of the addition of the detected values, and moreover, of performing boundary detection of the audio contents, and detecting the audio contents in which the digital watermark is embedded.

Furthermore, another digital watermark detection method according to the present invention includes: a first step of calculating a detected value which is a correlation coefficient between a frequency component of PCM data of audio contents and a pseudo random number sequence generated by a key used to embed the digital watermark, and of storing the detected value in storing means; a second step of accumulating the calculated detected value in accumulation cycles different from one another, of restoring a message embedded as the digital watermark from the accumulated detected values, and moreover, of performing boundary detection of the audio contents, of detecting the audio contents in which the digital watermark is embedded, and of storing detection results in the storing means; and a third step of receiving the detection results based on the plurality of accumulation cycles, and synthesizing and outputting detection results of the audio contents in the respective processing results, with the digital watermarks being embedded in the audio contents.

Moreover, the present invention is realized as a program for controlling a computer to execute processing corresponding to the respective steps of the above-described digital watermark detection methods, or as a program for allowing the respective functions of the above-mentioned digital watermark detection apparatuses to be realized by the computer. This program is provided by being stored in a magnetic disk, an optical disc, a semiconductor memory or other recording media and distributed, or by being distributed through a network.

According to the present invention constituted as described above, the robustness of the digital watermarks embedded in audio contents processed in various ways can be improved. Specifically, a method and system for appropriately detecting a digital watermark particularly from audio contents short in terms of time or deteriorated audio contents can be provided. Moreover, a method and system embedding and detecting a digital watermark particularly having a strong robustness to deterioration due to superposition of another sound on audio contents.

A best mode for carrying out the present invention (hereinafter, an embodiment) is described below in detail with reference to the accompanying drawings.

Here, the following two embodiments are described in order to enhance robustness of audio contents in consideration that the audio contents are provided in various modes.

(Embodiment 1) Detection of digital watermark by use of accumulation cycles (Embodiment 2) Embedding and detection of digital watermark by use of pseudo random number patterns

Embodiment 1

An embodiment in which a digital watermark is detected by use of a plurality of accumulation cycles is described.

When considering a mode of use of audio contents, audio contents deteriorated due to superposition of another sound thereon, such as audio contents used as a BGM, are audio contents having some length in terms of time. Meanwhile, audio contents of approximately two seconds, which are extremely short in terms of time, are used as a jingle or a sound effect for a broadcast program and hardly superposed on another sound. In other words, it can be said that, while it is necessary to accumulate detected values in a long accumulation cycle in order to cope with deterioration of audio contents having some length in terms of time and thus to restore a message (watermark information), the message can be restored relatively satisfactorily even from detected values accumulated in a short accumulation cycle, in the audio contents short in terms of time.

Moreover, as described in the "Problems to be Solved by the Invention," when the accumulation cycle of the detected values is prolonged, it becomes difficult to restore the message from audio contents short in terms of time.

Accordingly, in this embodiment, detected values of watermark signals are accumulated in a plurality of different accumulation cycles. Audio contents which are short in terms of time and resistant to deterioration and audio contents which have some length in terms of time and have a possibility of deterioration are coped with by means of appropriate accumulation cycles, and the message is restored.

FIG. 1 is a view schematically showing an example of a hardware configuration of a computer apparatus suitable for realizing the digital watermark detection apparatus according to this embodiment.

The computer apparatus shown in FIG. 1 includes a central processing unit (CPU) 101 as arithmetic means, a main memory 103, a video card 104, a magnetic disk device (HDD) 105, a network interface 106, a flexible disk drive 108, and a keyboard/mouse 109. The main memory 103 is connected to the CPU 101 through a motherboard (M/B) chipset 102 and a CPU bus. The video card 104 is connected to the CPU 101 through the same M/B chipset 102 and an accelerated graphics port (AGP). Moreover, the HDD 105 and the network interface 106 are connected to the M/B chipset 102 through a peripheral component interconnect (PCI) bus. Furthermore, the flexible disk drive 108 and the keyboard/mouse 109 are connected to the M/B chipset 102 through the PCI bus, a bridge circuit 107, and a low-speed bus such as an industry standard architecture (ISA) bus.

Note that FIG. 1 only illustrates the hardware configuration of the computer apparatus which realizes this embodiment, and other various configurations can be adopted as long as this embodiment is applicable thereto. For example, a configuration may be made, in which only a video memory is mounted instead of providing the video card 104, and image data is processed in the CPU 101. Alternatively, as an external storage device, a drive for a compact disc recordable (CD-R) or a digital versatile disc random access memory (DVD-RAM) may be provided through an interface such as AT attachment (ATA) or small computer system interface (SCSI).

Figure 2:
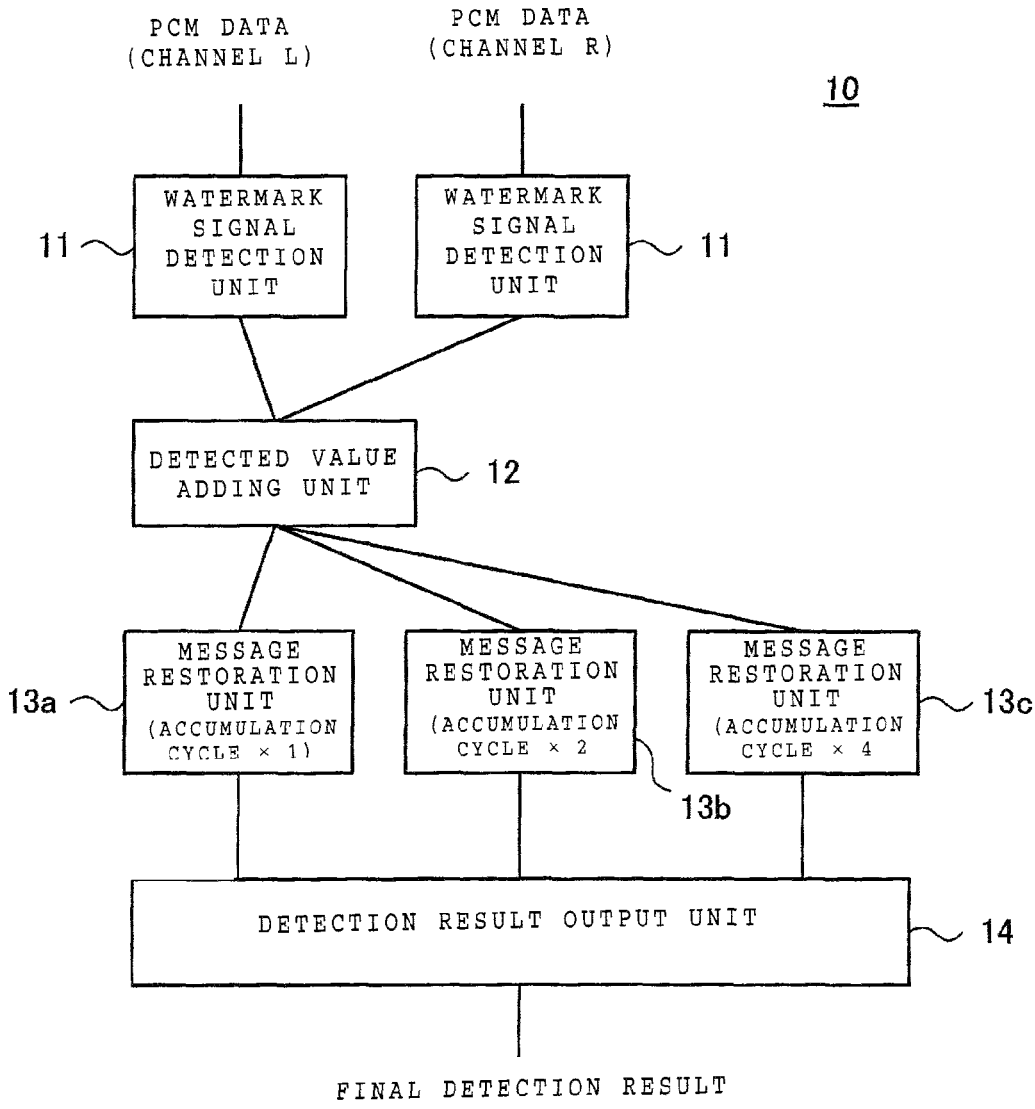
FIG. 2 is a view showing a functional configuration of a digital watermark detection apparatus of Embodiment 1.

FIG. 2 is a view showing a functional configuration of the digital watermark detection apparatus of this embodiment.

Referring to FIG. 2, the digital watermark detection apparatus 10 of this embodiment includes: watermark signal detection units 11 provided for each of channels, which detect watermark signals from data of the respective channels of the audio contents; a detected value adding unit 12 which adds detected values of the watermark signals detected by the respective watermark signal detection units 11; a plurality of message restoration units 13 which accumulate the obtained watermark signals and restore messages from the accumulated watermark signals; and a detection result output unit 14 which performs comparison processing for restoration results by the respective message restoration units 13 and outputs a comparison result as a final detection result.

The watermark signal detection units 11 are realized, for example, by the CPU 101 which is shown in FIG. 1 and controlled by a program, and detect watermark signals embedded in the data of audio contents. For a detection method of watermark signals, a detection method in an existing digital watermark technology can be used.

Figure 3:
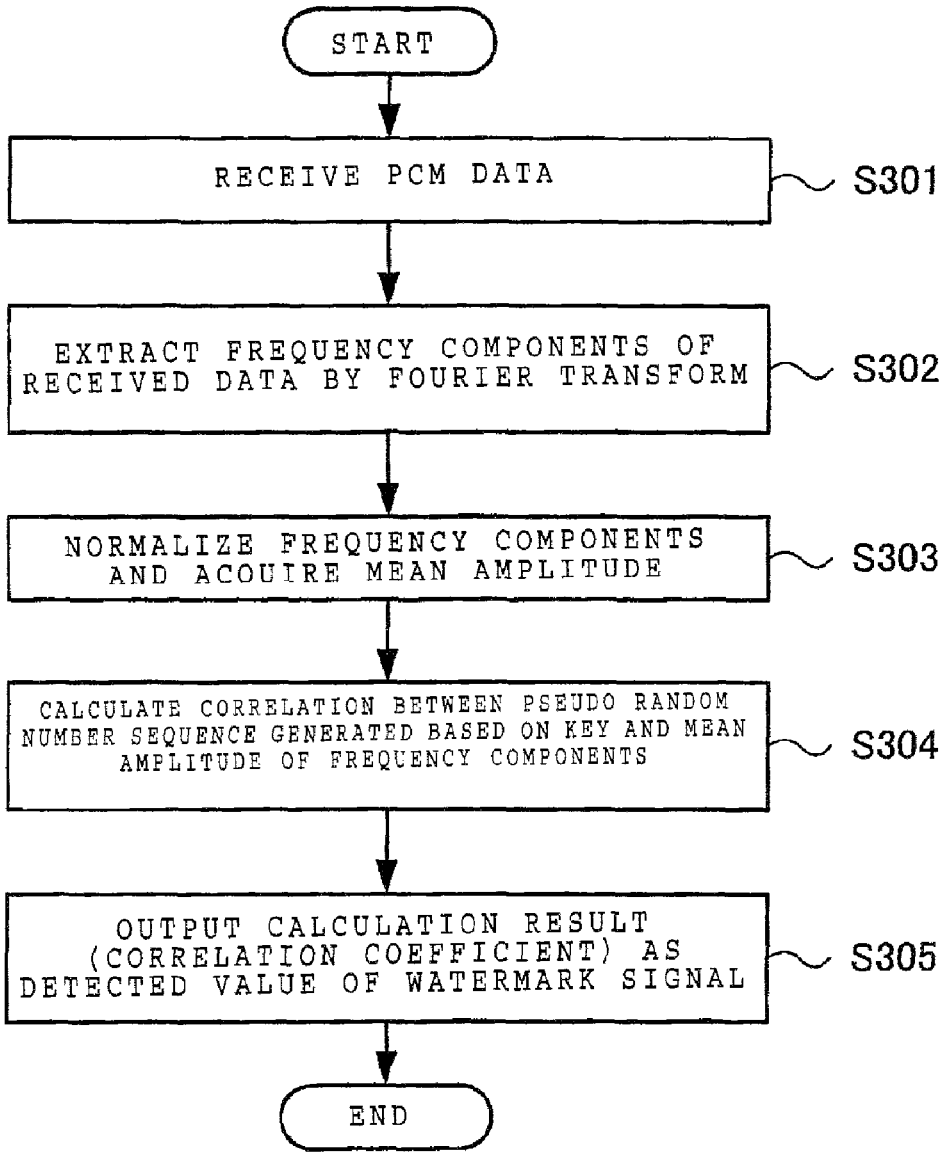
FIG. 3 is a flowchart showing a general detection procedure of watermark signals from audio contents.

FIG. 3 is a flowchart showing a general detection procedure of watermark signals for audio contents.

As shown in FIG. 3, each of the watermark signal detection units 11 first receives pulse code modulation (PCM) data of the audio contents (Step 301), and performs a Fourier transform on the received data to extract frequency components thereof (Step 302). Then, the watermark signal detection unit 11 normalizes data of the obtained frequency components, and acquires a mean amplitude for each portion of the audio data (Step 303). Next, the watermark signal detection unit 11 calculates a correlation between a pseudo random number sequence generated by a random number generator by use of the same key as the one used when the digital watermark is embedded and the mean amplitude of the frequency components, which is obtained in Step 303 (Step 304), and outputs a calculation result (correlation coefficient) as a detected value of the watermark signal (Step 305).

The calculated detected value is temporarily stored in a storage device, for example, such as the main memory 103 and a cache memory of the CPU 101 in FIG. 1.

The detected value adding unit 12 is realized, for example, by the CPU 101 which is shown in FIG. 1 and controlled by a program, and receives and adds together the detected values of the watermark signals detected by the respective watermark signal detection units 11 provided for each of the channels. The added detected value is temporarily stored in a storage device, for example, such as the main memory 103 and the cache memory of the CPU 101 in FIG. 1. Note that, in the example shown in FIG. 2, the audio contents are assumed to be one recorded in stereo, and the two watermark signal detection units 11 for a left and right audio are described. However, needless to say, the number of watermark signal detection units 11 is not limited to that in the illustrated example. The watermark signal detection units 11 can be provided in number corresponding to the number of channels of audio contents, and in the case of monaural audio contents, one watermark signal detection unit 11 may be provided. When one watermark signal detection unit 11 is provided, the adding processing of detected values is unnecessary, and the detected value adding unit 12 is not an essential constituent element.

Each of the message restoration units 13 is realized, for example, by the CPU 101 and the storing means such as the main memory 103 which are shown in FIG. 1, accumulates the detected value of the watermark signal added by the detected value adding unit 12 (the detected value extracted by the watermark signal detection unit 11 when only a watermark signal detection unit 11 is provided) in a buffer realized by the main memory 103 or the like till an amount for a certain period of time, and restores the message based on the detected values accumulated and intensified together. Specifically, when the received detected value (correlation coefficient between the mean amplitudes of the frequency components of the PCM data and the pseudo random number sequence generated by use of the key) is larger than a preset threshold value, it is determined that the watermark is embedded, and the message is restored from such a detected value. For a restoring method of the message, a restoring method in an existing digital watermark technology can be used.

Moreover, the message restoration units 13 detect boundaries of the audio contents based on the respective restoration results of the messages. The restoring of the messages and the detection of the boundaries of the audio contents are performed, and thus the audio contents in which the digital watermarks are embedded are detected. Portions which are not determined to be audio contents in which the digital watermarks are embedded in the PCM data are determined to be audio contents in which the digital watermarks are not embedded.

In this embodiment, as shown in FIG. 2, the plurality of message restoration units 13 are provided, and the accumulation cycles for the detected values are made to differ from one another. In the illustrated example, three types of message restoration units 13 which individually have a reference accumulation cycle, an accumulation cycle twice as much as the reference and an accumulation cycle four times as much as the reference are described. However, needless to say, the number of message restoration units 13 and the accumulation cycles are not limited to those in the illustrated example. Note that, in the description below, when it is necessary to distinguish the respective message restoration units 13 from one another, a suffix is added to the respective message restoration units 13. The message restoration unit 13 which has the reference accumulation cycle is written as a message restoration unit 13*a*, the message restoration unit 13 which has the accumulation cycle twice as much as the reference is written as a message restoration unit 13*b*, and the message restoration unit 13 which has accumulation cycle four times as much as the reference is written as a message restoration unit 13*c*. Meanwhile, in the case where it is unnecessary to distinguish these message restoration units, these message restoration units are simply written as the message restoration units 13.

As described above, audio contents deteriorated due to superposition of another sound thereon have some length in terms of time, and accordingly, the message restoration units 13 of which accumulation cycles are long are provided in order to cope with such audio contents having a possibility of deterioration. Therefore, as accumulation cycles of message restoration units 13 become higher, threshold values for restoring the messages from detected values may be set higher. Thus, the message restoration unit 13*b* becomes less prone to be affected by an influence of the deterioration caused by superposition of another sound thereon than the message restoration unit 13*a*, the message restoration unit 13*c* becomes less prone than the message restoration unit 13*b*, and noise due to the deterioration is removed appropriately, thus making it possible to restore the messages correctly.

The messages restored by the respective message restoration units 13 are individually held temporarily in storage device such as, for example, the main memory 103 and the cache memory of the CPU 101 in FIG. 1.

The detection result output unit 14 is realized, for example, by the CPU 101 which is shown in FIG. 1 and controlled by a program. The detection result output unit 14 compares and integrates the detection results of the audio contents in which the digital watermarks are embedded, the results being obtained by the plurality of message restoration units 13, and creates and outputs the final detection result according to the following rules.

Rule 1: When the audio contents in which the digital watermark is embedded are detected by any of the message restoration units 13, the detection result output unit 14 determines the audio contents as audio contents in which the digital watermark is embedded, and outputs the detection result. Specifically, only when the audio contents in which the digital watermark is embedded are not detected by any of the message restoration units 13, the detection result output unit 14 determines the portion concerned as the audio contents in which the digital watermark is not embedded.

Rule 2: When the audio contents in which the digital watermark is embedded are detected by the plurality of message restoration units 13, the detection result output unit 14 prioritizes the detection result by a message restoration unit 13 of which accumulation cycle is shorter. Specifically, when contents of the messages restored by a plurality of message restoration units 13 contradict one another, the detection result output unit 14 employs the message restored by a message restoration unit 13 of which accumulation cycle is shorter as the detection result.

Rule 3: When the audio contents in which the digital watermark is embedded is detected by a predetermined message restoration unit 13, the detection result output unit 14 outputs the detection result without waiting for detection of the audio contents in which the digital watermark is embedded by the other message restoration unit 13 of which accumulation cycle is longer than that of the predetermined message restoration unit 13. This is because the detection result by a message restoration unit 13 of which accumulation cycle is shorter is prioritized by Rule 2, and thus the detection result by a message restoration unit 13 of which accumulation cycle is longer does not affect the final detection result by the detection result output unit 14.

Moreover, in the integration processing of the detection results, the detection result output unit 14 integrates results of the boundary detection of the audio contents by the respective message restoration units 13, and performs appropriate boundary detection.

Figure 4:
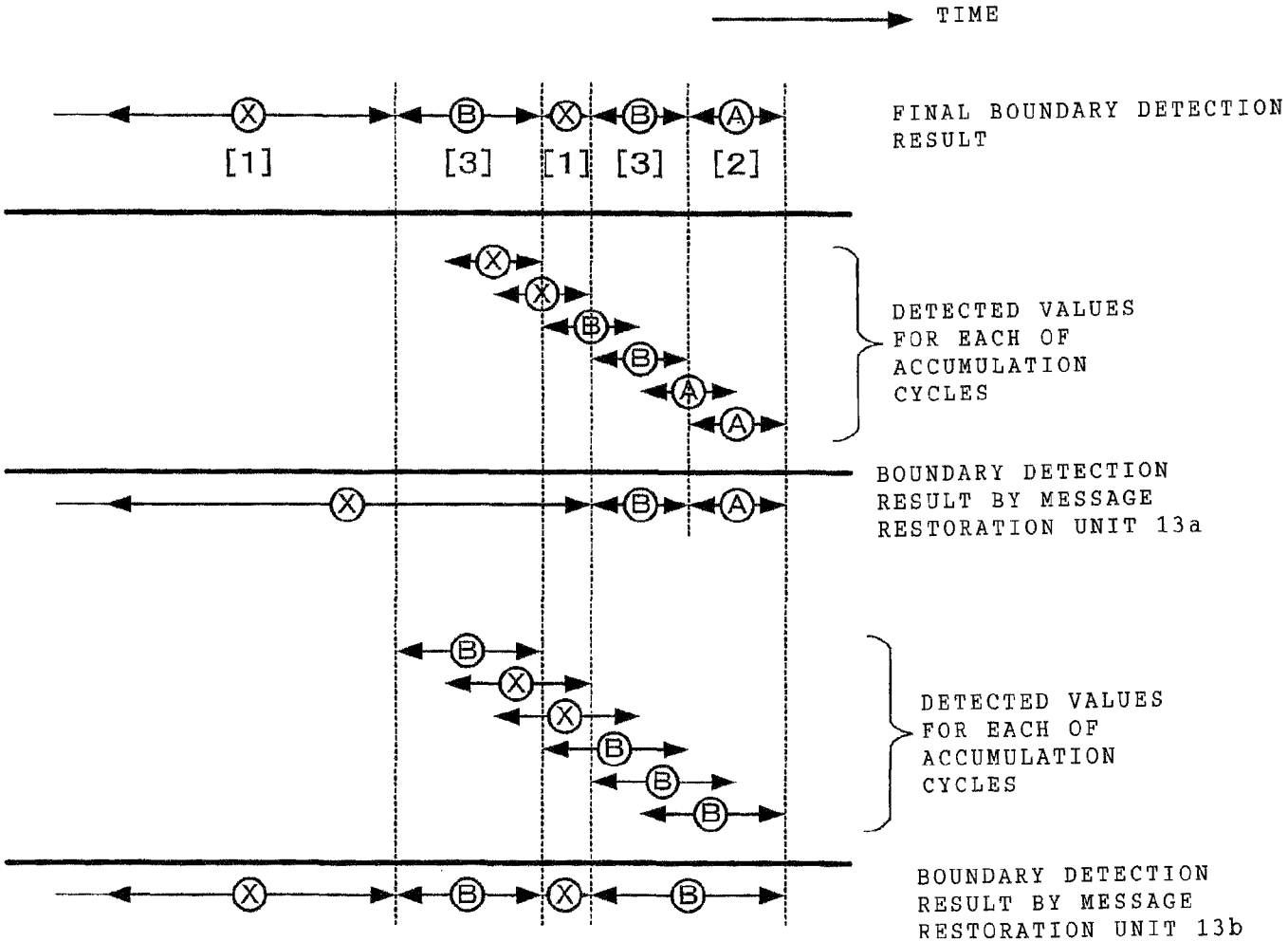
FIG. 4 is a view showing a state of integrating boundary detection results by a plurality of message restoration units in Embodiment 1.

FIG. 4 is a view showing a state of integrating boundary detection results by the message restoration units 13*a* and 13*b*. Note that the message restoration units 13*a* and 13*b* determine the existence of the watermark information and restore the watermark information based on the detected values accumulated in each of the accumulation cycles. Moreover, as shown in FIG. 4, it is assumed that the message restoration units 13*a* and 13*b* accumulate the detected values for the amount corresponding to the respective accumulation cycles by use of a plurality of buffers while slightly shifting the time. Thus, highly precise boundary detection can be performed by using shifts in accumulating time between the respective buffers as a unit without using the accumulation cycles of the respective message restoration units 13 as a unit.

The following case is assumed: where there is PCM data in which audio contents [1] having no digital watermark embedded therein, audio contents [2] having a message A embedded therein, and audio contents [3] having a message B embedded therein continue in such an order of [1], [3], [1], [3] and [2].

In this case, referring to FIG. 4, it is understood that the message restoration unit 13*a* was not able to detect audio contents [3] which appeared first between audio contents [3] which appeared twice. This means that the message B in the audio contents [3] was not able to be restored from detected values accumulated in the short accumulation cycle because the audio contents [3] had some length and were deteriorated.

However, the message B in the audio contents [3] concerned is detected by the message restoration unit 13*b* having a longer accumulation cycle. Hence, according to the above-described Rule 1, the boundary of the audio contents is determined based on the detection result by the message restoration unit 13*b*.

Meanwhile, it is understood that the message restoration unit 13*b* was not able to detect the audio contents [2] which appeared finally in the PCM data. This means the following: the audio contents [3] which appeared immediately before the audio contents [2] concerned are contained in the accumulation cycle because the audio contents [2] are extremely short; the message A in the audio contents [2] and the message B in the audio contents [3] are mixed in the detected value; and thus the message A was not able to be restored. Note that, as a general action of the message restoration units 13, a current state is maintained until a message different from a current message is restored or until it is settled that a different message is not restored, and accordingly, in the detection result by the message restoration unit 13*b* in FIG. 4, the audio contents [3] are maintained.

However, the message A in the audio contents [2] concerned is detected by the message storing unit 13*a* having the short accumulation cycle. Therefore, according to the above-mentioned Rule 2, the boundary of the audio contents is determined based on the detection result by the message restoration unit 13*a*.

An action of the detection result output unit 14 is described below in detail by giving a specific detection example.

Figure 5:
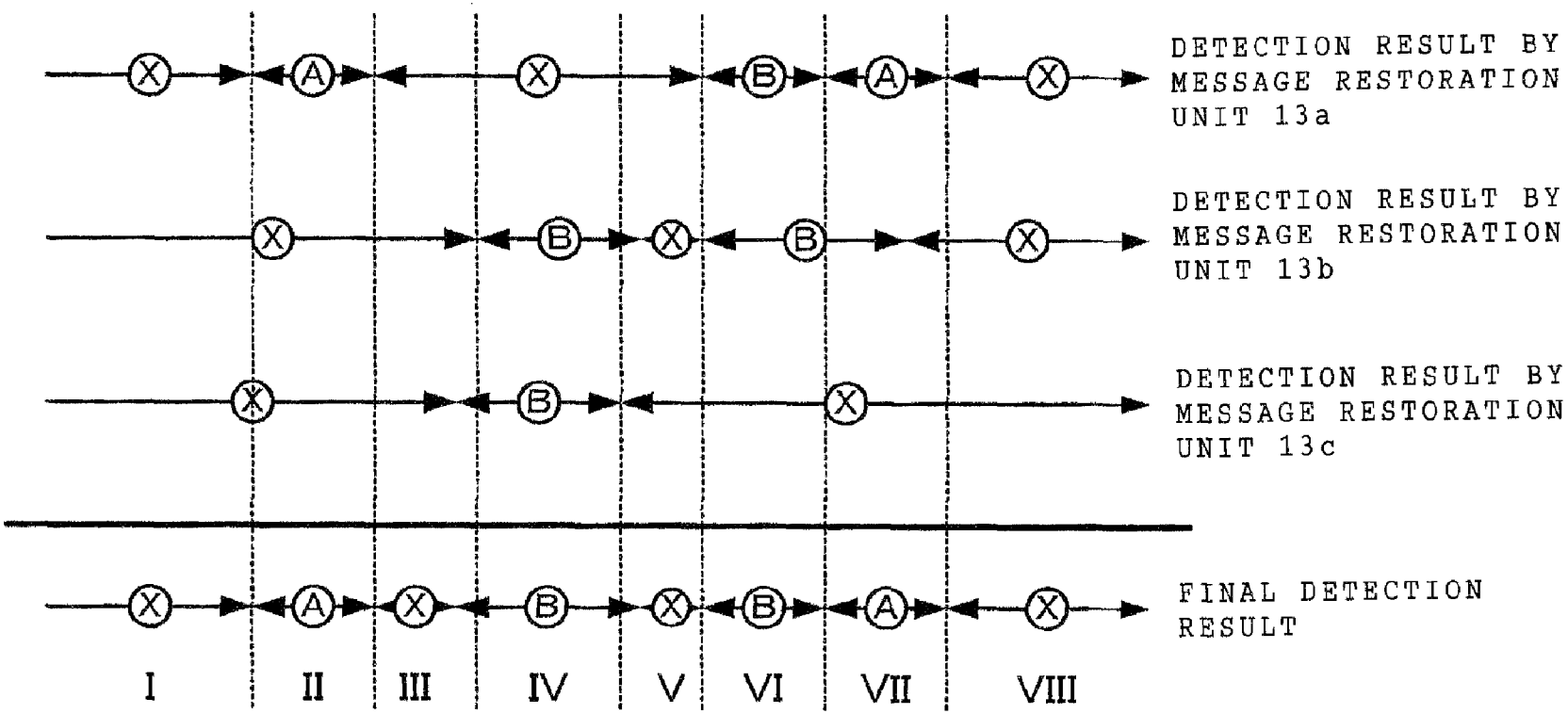
FIG. 5 is a view for explaining relationships between results of restoring messages by the respective message restoration units and a final detection result outputted from a detection result output unit in Embodiment 1.

FIG. 5 is a view for explaining relationships between results of restoring the messages by the respective message restoration units 13 and a final detection result outputted from the detection result output unit 14.

In FIG. 5, in the PCM data to be processed, as in the case of FIG. 4, audio contents [1] in which no digital watermark is embedded, audio contents [2] in which a message A is embedded, and audio contents [3] in which a message B is embedded, are contained. Moreover, the PCM data in the illustrated range is separated into eight sections from Sections I to VIII based on results of detecting boundaries. The respective Sections are examined.

In Section I, no message is restored in any of the respective message restoration units 13*a*, 13*b* and 13*c*. Accordingly, a final detection result of Section I also becomes the audio contents [1] in which no message is embedded.

In Section II, the message A is restored by the message restoration unit 13*a*, and accordingly, a final detection result of Section II becomes the audio contents [2] in which the message A is embedded according to the above-mentioned Rules 2 and 3. Moreover, a length of Section II is determined based on the boundary detection result by the message restoration unit 13*a*.

In Section III, no message is restored in any of the respective message restoration units 13*a*, 13*b* and 13*c*. Accordingly, a final detection result of Section III also becomes the audio contents [1] in which no message is embedded.

In Section IV, the messages B are restored by the message restoration units 13*b* and 13*c*, and accordingly, a final detection result of Section IV becomes the audio contents [3] in which the message B is embedded according to the above-mentioned Rule 1. Moreover, a length of Section IV is determined in a manner that a section of the audio contents [3] (section where the message 6B is restored) by a boundary detection result of the message restoration unit 13*c* and a section of the audio contents [3] by a boundary detection result of the message restoration unit 13*b* are superposed on each other.

In Section V, no message is restored in any of the respective message restoration units 13*a*, 13*b* and 13*c*. Accordingly, a final detection result of Section V also becomes the audio contents [1] in which no message is embedded.

In Section VI, the messages B are restored by the message restoration units 13*a* and 13*b*, and accordingly, a final detection result of Section VI becomes the audio contents [3] in which the message B is embedded according to the above-mentioned Rule 1. A length of Section VI is explained in combination with that of the next Section VII.

In Section VII, the message A is restored by the message restoration unit 13*a*. Moreover, in a part of Section VII, the message B is restored by the message restoration unit 13*b*. Detection results by the message restoration unit 13*a* and the message restoration unit 13*b* contradict each other. However, the detection result by the message restoration unit 13*a* of which accumulation cycle is shorter is prioritized according to the above-mentioned Rule 2, and a final detection result of Section VII becomes the audio contents [2] in which the message A is embedded.

Here, the lengths of Sections VI and VII are described. When assuming a section formed by adding Sections VI and VII, the message restoration unit 13*b* restores the message B from Section VI to a part of Section VII, and performs the boundary detection while regarding this described section as a section of the audio contents [3]. Meanwhile, the message restoration unit 13*a* restores the message B and the message A, and performs the boundary detection while regarding the section where the message B is restored as a section of the audio contents [3] and the section where the message A is restored as a section of the audio contents [2]. Rules 2 and 3 are applied to these boundary detection results, and the lengths of Sections VI and VII are determined based on the boundary detection results by the message restoration unit 13*a*.

In Section VIII, no message is restored in any of the respective message restoration units 13*a*, 13*b* and 13*c*. Accordingly, a final detection result of Section VIII also becomes the audio contents [1] in which no message is embedded.

As described above, in this embodiment, messages embedded in audio contents by digital watermarks are restored by use of the plurality of message restoration units 13 having different accumulation cycles. Thus, a message restoration unit 13 of which accumulation cycle is shorter copes with audio contents short in terms of time, and a message restoration unit 13 of which accumulation cycle is longer copes with audio contents which have some length and a possibility of deterioration, thus making it possible to restore the messages embedded in the audio contents.

Moreover, because the audio contents short in terms of time have less possibility of deterioration due to superposition of another sound thereon, this embodiment prioritizes the detection result by the message restoration unit 13 of which accumulation cycle is shorter, which copes with the audio contents short in terms of time. Then, when the message is restored and the digital watermark is detected by the message restoration unit 13 of which accumulation cycle is shorter, the detection result is outputted without waiting for the restoring of the message by the other message restoration units 13. Therefore, a time required for detecting the digital watermark can be shortened by not waiting for the restoring of the message by the message restoration units 13 of which accumulation cycles are longer.

Embodiment 2

Next, an embodiment of embedding and detecting a digital watermark by use of a plurality of pseudo random number patterns is described.

A digital watermark embedding apparatus and a digital watermark detection apparatus according to this embodiment, are realized, for example, by the computer apparatus as in FIG. 1, which is shown in Embodiment 1.

Figure 6:
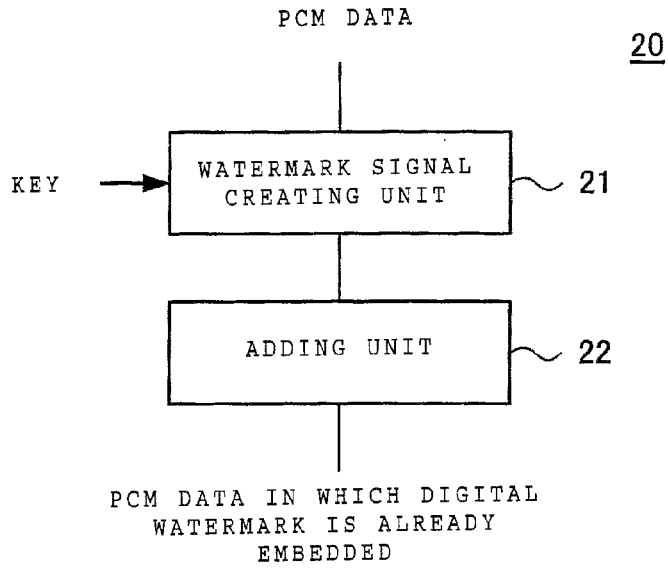
FIG. 6 is a view showing a functional configuration of a digital watermark embedding apparatus of Embodiment 2.

FIG. 6 is a view showing a functional configuration of the digital watermark embedding apparatus of this embodiment.

Referring to FIG. 6, a digital watermark embedding apparatus 20 of this embodiment includes a watermark signal creating unit 21 which creates the watermark signal to be embedded in audio contents, and an adding unit 22 which adds the created watermark signal and original audio contents together to create audio contents in which the digital watermark is already embedded. In this embodiment, a plurality of digital watermarks are embedded in audio data in the plurality of respective channels in the audio contents composed of the channels concerned. A configuration shown in FIG. 6 is a configuration for embedding digital watermarks in audio data of one channel. Moreover, for an embedding method of digital watermarks in the respective channels, an embedding method in an existing digital watermark technology can be used.

Figure 7:
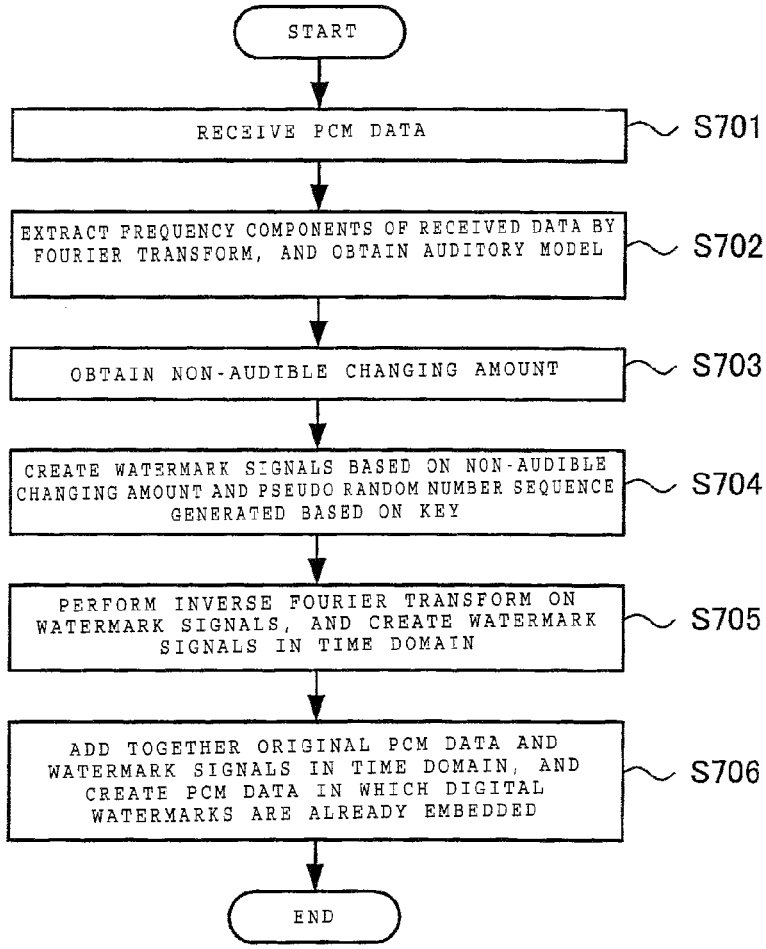
FIG. 7 is a flowchart showing a general embedding procedure of digital watermarks in audio contents.

FIG. 7 is a flowchart showing a general embedding procedure of watermark signals in audio contents. As shown in FIG. 7, a watermark signal creating unit 21 first receives PCM data as an aspect to be processed (Step 701), and performs a Fourier transform on the received data to extract frequency components thereof, thus obtaining an auditory model (Step 702). Then, by use of this auditory model, the watermark signal creating unit 21 obtains an imperceptible non-audible changing amount (Step 703). Next, the watermark signal creating unit 21 changes frequency components of the PCM data extracted in Step 702, based on the non-audible changing amount obtained in Step 703 and a pseudo random number sequence generated by a random number generator by use of a predetermined key, thus creating watermark signals in the frequency domain (Step 704). Then, the watermark signal creating unit 21 performs an inverse Fourier transform on the obtained watermark signals in the frequency domain, thus creating watermark signals in the time domain (Step 705).

When the watermark signals are created, the adding unit 22 adds together the PCM data as the aspect to be processed and the watermark signals in the time domain, which are created by the watermark signal creating unit 21, thus creating PCM data in which the digital watermarks are already embedded (Step 706).

Here, in this embodiment, the digital watermarks are embedded in the PCM data of the respective channels according to the above-described procedure, and in Step 704, the watermark signal creating unit 21 creates the pseudo random number sequence for the respective channels by use of a plurality of keys, thus creating the watermark signals. Hence, the digital watermarks embedded in the respective channels differ in the watermark signals added to the original PCM data though messages thereof are the same. Note that, in order to allow the watermark signals added to the data of the respective channels to entirely differ from one another, the number of keys is equalized to the number of channels of the audio contents.

Figure 8:
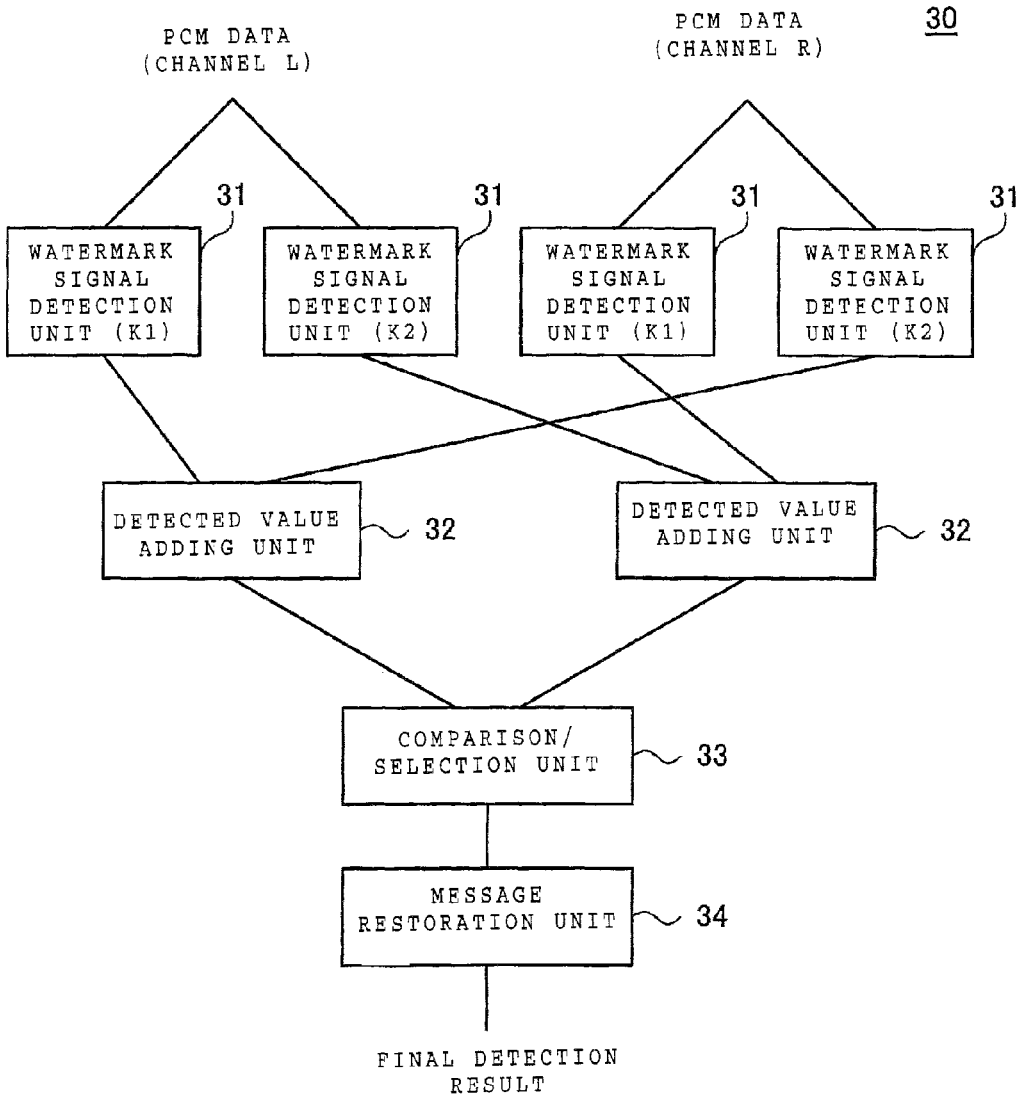
FIG. 8 is a view showing a functional configuration of a digital watermark detection apparatus of Embodiment 2.

FIG. 8 is a view showing a functional configuration of the digital watermark detection apparatus of this embodiment. Referring to FIG. 8, the digital watermark detection apparatus 30 of this embodiment includes: watermark signal detection units 31 which detect the watermark signals from the data of the respective channels of the audio contents; detected value adding units 32 which add together detected values of the watermark signals detected by the watermark signal detection units 31; a comparison/selection unit 33; and a plurality of message restoration units 34 which accumulate the obtained watermark signals and restore messages from the accumulated watermark signals.

In this embodiment, as described above, the digital watermarks are embedded in the plurality of channels of the audio contents by the watermark signals created by use of the plurality of keys. Accordingly, the digital watermark detection apparatus 30 of this embodiment detects the watermark signals from the data of the respective channels of the audio contents by use of the respective keys used for embedding the digital watermarks. Then, the digital watermark detection apparatus 30 synthesizes the obtained detected values in various ways of possible combinations, selects appropriate combinations, and restores the messages. Hereinafter, for simplicity, it is assumed that the audio contents are recorded in two-channel stereo (channels L and R), and description is made by taking as an example the case where digital watermarks are embedded in the data of the respective channels by use of watermark signals created by two keys (K1 and K2).

The watermark signal detection units 31 are realized, for example, by the CPU 101 which is shown in FIG. 1 and controlled by a program, and detect watermark signals embedded in the data of the audio contents. For a detection method of watermark signals, a detection method in an existing digital watermark technology, for example, the detection method according to the procedure shown in FIG. 3, which is described in Embodiment 1, can be used. Obtained detected values are temporarily held in a storage device such as, for example, the main memory 103 and the cache memory of the CPU 101 in FIG. 1.

Here, in this embodiment, it is necessary to detect the watermark signals created in the data of the two channels (L and R) by use of the keys (K1 and K2) different from each other. It is not known, in the data of each of the two channels, which of the keys is used for the embedding of watermarks. Accordingly, for the data of each channel, a watermark signal detection unit 31 which detects watermark signals by use of the key K1 and a watermark signal detection unit 31 which detects watermark signals by use of the key K2 are individually prepared. In FIG. 8, four watermark signal detection units 31 are illustrated because two watermark signal detection units 31 are provided for each channel. Hereinafter, in the case of distinguishing these watermark signal detection units 31 from one another, types of the channels and the keys are added thereto as suffix, and the watermark signal detection units are denoted such as watermark signal detection unit 31LK1 and watermark signal detection unit 31RK2. Meanwhile, in the case where it is unnecessary to distinguish these watermark signal detection units, these watermark signal detection units are simply denoted as watermark signal detection units 31.

Note that, though the four watermark signal detection units 31 are illustrated in FIG. 8 as described above, in general, the number of keys is n when the number of channels is n, and accordingly, it is necessary to prepare $n^2$ pieces of watermark signal detection units 31.

Moreover, a configuration is also conceivable, in which information indicating which of the keys is used for the embedding of digital watermarks is provided in the data of the respective channels from the digital watermark embedding apparatus 20 to the digital watermark detection apparatus 30, and thus the number of watermark signal detection units 31 are reduced. However, when considering that the data of the respective channels change places with each other by only changing cables on instruments on a path where the audio contents are distributed, it is preferable to prepare the four watermark signal detection units 31 described above.

The detected value adding units 32 are realized, for example, by the CPU 101 which is shown in FIG. 1 and controlled by a program, and add the detected values of watermark signals obtained by the above-mentioned plurality of watermark signal detection units 31 in all possible combinations. The calculated detected values are temporarily held in a storage device such as, for example, the main memory 103 and a cache memory of the CPU 101 in FIG. 1.

Here, when the watermarks are embedded in the data of the two channels (L and R) by use of the keys (K1 and K2) different from each other, it is understood that the different keys are used for the data of the respective channels, and accordingly, possible combinations are two, which are: a combination of the detected values by the watermark signal detection units 31LK1 and 31RK2; and a combination of the detected values by the watermark signal detection units 31LK2 and 31RK1. Hence, as shown in FIG. 8, two detected value adding units 32 which add detected values in these two combinations are prepared.

In general, a combination of the same channels or the same keys has no possibility to be present, and accordingly, the number of possible combinations is n!, and it is necessary to prepare n! pieces of detected value adding units 32.

Incidentally, when the audio contents from which digital watermarks are to be detected are received as one-channel monaural contents though the audio contents are originally two-channel stereo contents, possible combinations differ from those in the above-described case.

Figure 9:
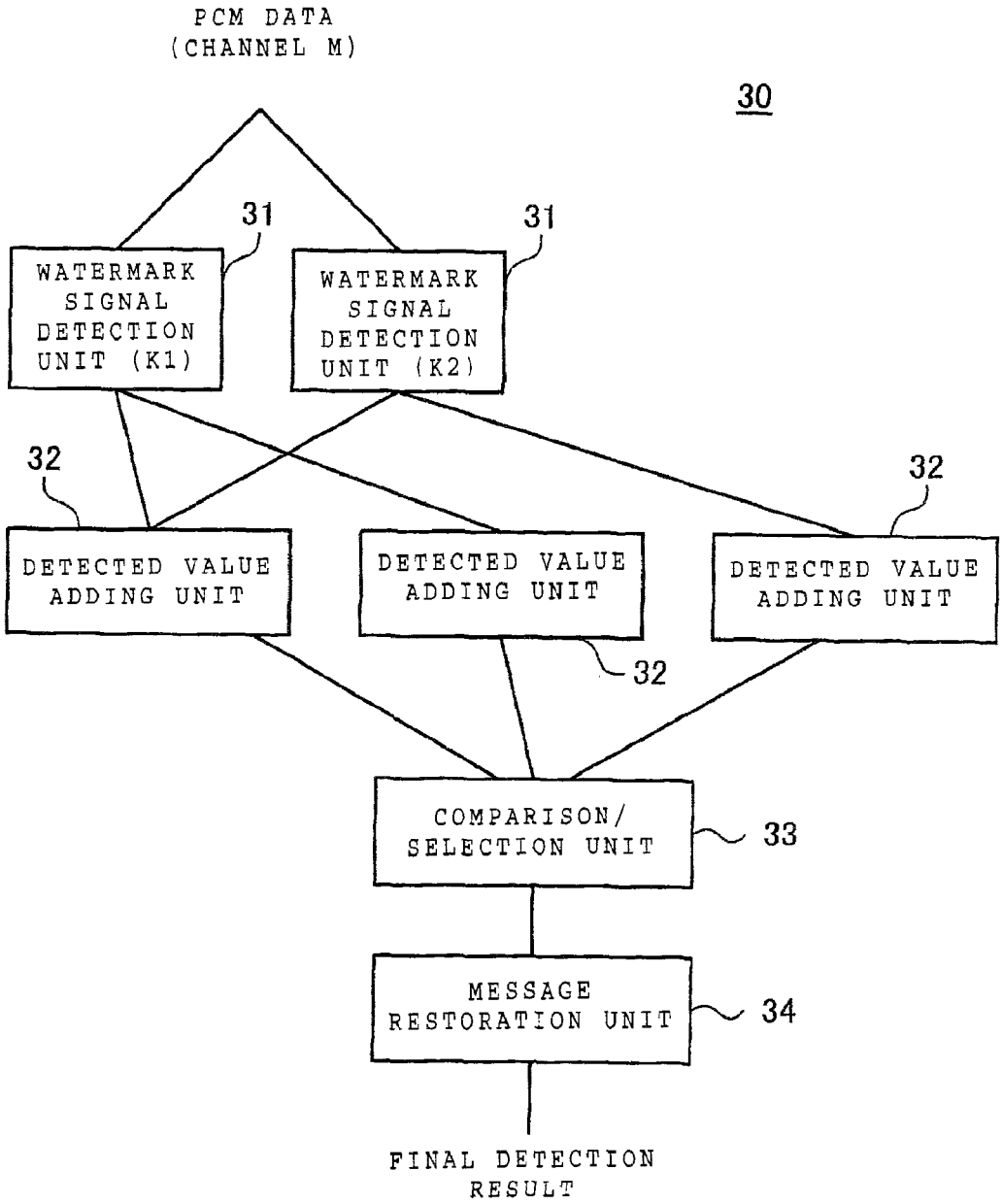
FIG. 9 is a view showing a configuration example of watermark signal detection units and detected value adding units for detecting digital watermarks from monaural contents in Embodiment 2.

FIG. 9 is a view showing a configuration example of watermark signal detection units 31 and detected value adding units 32 for detecting digital watermarks from monaural contents.

In the monaural contents, digital watermarks are embedded by the watermark signals created by use of the key K1 or the key K2 as in the above-described case, and accordingly, two watermark signal detection units 31 are used, which are: a watermark signal detection unit 31MK1 which detects watermark signals from the one-channel (channel M) data by use of the key K1; and a watermark signal detection unit 31MK2 which detects watermark signals therefrom by use of the key K2.

As a mode in which the two-channel stereo contents are converted into the one-channel monaural content, there are two cases, which are: a case where the data of the two channels are added together; and a case where any one of the data of the two channels is deleted. Therefore, as cases of monaural contents, there are cases which are: a case where both of the digital watermarks using the key K1 and the key K2 are embedded; a case where digital watermarks using the key K1 is embedded; and a case where digital watermarks using the key K2 is embedded. Accordingly, a detected value adding unit 32 which adds together the detected values by the watermark signal detection units 31MK1 and 31MK2 in combination with each other, a detected value adding unit 32 which receives the detected value by the watermark signal detection unit 31MK1 and outputs the detected value as is, and a detected value adding unit 32 which receives the detected value by the watermark signal detection unit 31MK2 and outputs the detected value as is, are prepared. Note that watermark signal detection units 32 which output one of the detected values by the watermark signal detection unit 31MK1 and the detected value by the watermark signal detection unit 31MK2 as is are not essential constituent elements, and it is also possible to allow a storage device to hold the detected values by one of the watermark signal detection unit 31MK1 and the watermark signal detection unit 31MK2 as is and to allow the comparison/selection unit 33 to be described later to process the detected values.

The comparison/selection unit 33 is realized, for example, by the CPU 101 which is shown in FIG. 1 and controlled by a program, compares the outputs of the respective detected value adding units 32 with one another, and selects and outputs best detected values. The selected best detected values are temporarily held in a storage device such as, for example, the main memory 103 and a cache memory of the CPU 101 in FIG. 1.

Although various methods are conceivable as a technique of selecting the best detected values, for example, the following methods can be adopted.

- Defining a value in which the sum of absolute values of the detected values is maximum as the best detected value.
- Defining a value in which the sum of squares of the detected values is maximum as the best detected value.
- Performing error correction for the detected values, and defining a value in which the number of bits, an error has occurred therein, is minimum as the best detected value.
- Performing the error correction for the detected values, calculating signal-to-noise ratios (SNRs) by obtaining correct symbols of individual bits, and defining a value in which the obtained SNR is maximum as the best detected value.

The message restoration unit 34 is realized, for example, by the CPU 101 which is shown in FIG. 1 and controlled by a program, accumulates the best detected values selected in the comparison/selection unit 33 in a buffer realized by the main memory 103 or the like till an amount for a certain period of time, and restores massages based on the detected values accumulated and intensified together. Specifically, when the received values (or correlation coefficients between a mean amplitude of frequency components of a PCM data and a pseudorandom number sequence generated by use of a key) are larger than a preset threshold value, the message restoration unit 34 determines that digital watermarks are embedded, and restores the messages from such detected values. For a restoring method of messages, a restoring method in an existing digital watermark technology can be used. Moreover, the message restoration unit 34 performs boundary detection of audio contents based on restoration results of the respective messages. Then, the restored messages and boundary detection results are outputted as a final detection result.

In such a way, the embedding of digital watermarks using a plurality of pseudo random number patterns and the detection of such digital watermarks are realized. As described above, digital watermarks embedded by use of pseudo random number patterns by use of a plurality of keys are detected from data processed by the pseudo random number patterns by the keys for use when the digital watermarks are embedded. Specifically, in order to detect watermark signals from the data of the plurality of channels, different pieces of processing by different keys are implemented for the data of the respective channels in the watermark signal detection units 31. Therefore, even if a sound analogous to a monaural sound, such as a narration, is superposed on audio contents, the superposed sound becomes data sequences completely different from each other for each of the channels through the processing by pseudo random number patterns generated by use of the keys, and the correlation therebetween becomes lowered. Hence, while components of watermark signals in the detected values are intensified together by being added together in detected value adding units 32, components of audio data superposed on the audio contents are not intensified together, and accordingly, it becomes easy to detect watermark signals.

In this embodiment, digital watermarks are embedded in respective pieces of data of a plurality of channels of audio contents by watermark signals created by use of keys different from each other. However, when audio contents are two-channel stereo contents, a configuration may be adopted, in which a pseudo random number sequence generated by use of a key is allowed to change sign and to be used as two pseudo random number sequences, and watermark signals are created and embedded in the data of the respective channels. In such a way, when detecting the digital watermarks, differences between the detected values by the watermark signal detection units 31 in the respective channels are subtracted, and thus influences of the monaural sounds superposed on the audio contents are cancelled each other out. Only the components of the watermark signals in the detected values can be intensified together, and it becomes easier to detect the watermark signals.

Moreover, when embedding watermark signals in the data of the respective channels, it is also possible to perform a so-called permutation encryption. In this case, permutation is performed and decryption of the watermark information is performed when the detected values by the watermark signal detection units 31 are added together in detected value adding units 32. In such a way, security of digital watermarks can be enhanced.

Moreover, when completely different audio contents are individually recorded in a plurality of channels, there is also a possibility that the components of the watermark signals in the detected values are not appropriately intensified together even if the detected values from the data of the respective channels are added together. Accordingly, in a use environment where there is a possibility of receiving such audio contents as aspects from which digital watermarks are to be detected, it is preferable to set not only the values obtained by adding together the detected values from the data of the respective channels but also the detected values from the data of the respective channels as they are as aspects to be processed in the comparison/selection unit 33.

In the functional configuration of the digital watermark detection apparatus 30 according to this embodiment, which is shown in FIG. 8, the comparison/selection unit 33 compares the respective adding results of the detected values added together for each of the possible combinations of the respective channels and keys in the detected value adding units 32, and selects an adding result, and the message restoration unit 34 restores the messages of the digital watermarks from the selected adding result. However, a configuration can be adopted, in which the best restoration result is selected and outputted after restoring the messages.

Figure 10:
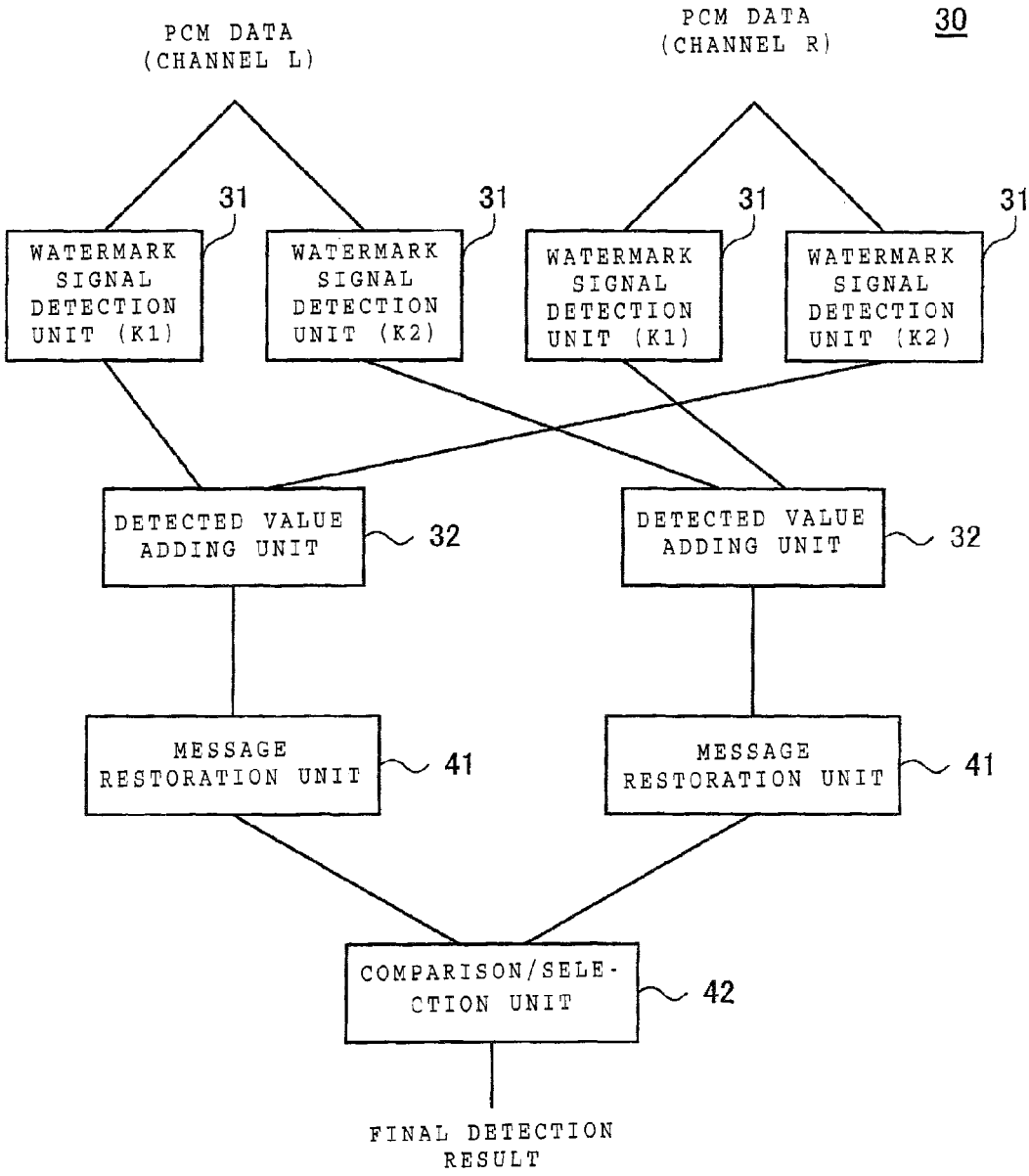
FIG. 10 is a view showing a functional configuration in a case of selecting and outputting a best restoration result after restoring the messages in Embodiment 2.

FIG. 10 is a view showing a functional configuration when the best restoration result is selected and outputted after restoring the messages. In FIG. 10, watermark signal detection units 31 and detected value adding units 32 are similar to the watermark signal detection units 31 and the detected value adding units 32, which are described with reference to FIG. 8, and accordingly, the same reference numerals are added thereto, and description thereof is omitted.

A plurality of message restoration units 41 are realized, for example, by the CPU 101 which is shown in FIG. 1 and controlled by a program, and are provided so as to correspond to the detected value adding units 32. Then, the message restoration units 41 individually receive adding results by the plurality of detected value adding units 32, accumulate the adding results till an amount for a certain period of time in a buffer realized by the main memory 103 and the like, and restore the messages based on the detected values accumulated and intensified together. For a restoring method of the messages, a restoring method in an existing digital watermark technology can be used as in the message restoration unit 34 shown in FIG. 8. Moreover, the message restoration units 41 perform the boundary detection of audio contents based on the respective restoration results of the messages. The restored messages are temporarily held in a storage device such as, for example, the main memory 103 and a cache memory of the CPU 101 in FIG. 1.

A comparison/selection unit 42 is realized, for example, by the CPU 101 which is shown in FIG. 1 and controlled by a program, compares the restoration results of the messages by the plurality of message restoration units 41, and selects and outputs appropriate series of messages. For a selection method of the messages, various methods are conceivable. For example, a message embedded by the digital watermark embedding apparatus 20 is given to the digital watermark detection apparatus 30 in advance, and this message and the messages restored by the respective message restoration units 41 are individually compared, and thus a coinciding one can be selected. Moreover, whether or not the messages are meaningful can be determined based on an intended purpose of the digital watermarks (for example, displaying an origin of the contents), and thus a meaningful message can be selected.

As above, Embodiment 1 which performs the detection of the digital watermark by use of the plurality of accumulation cycles and Embodiment 2 which performs the embedding and detection of the digital watermark by use of the plurality of pseudo random number patterns are described. It is also possible to constitute a digital watermark detection apparatus by combining these embodiments.

Figure 11:
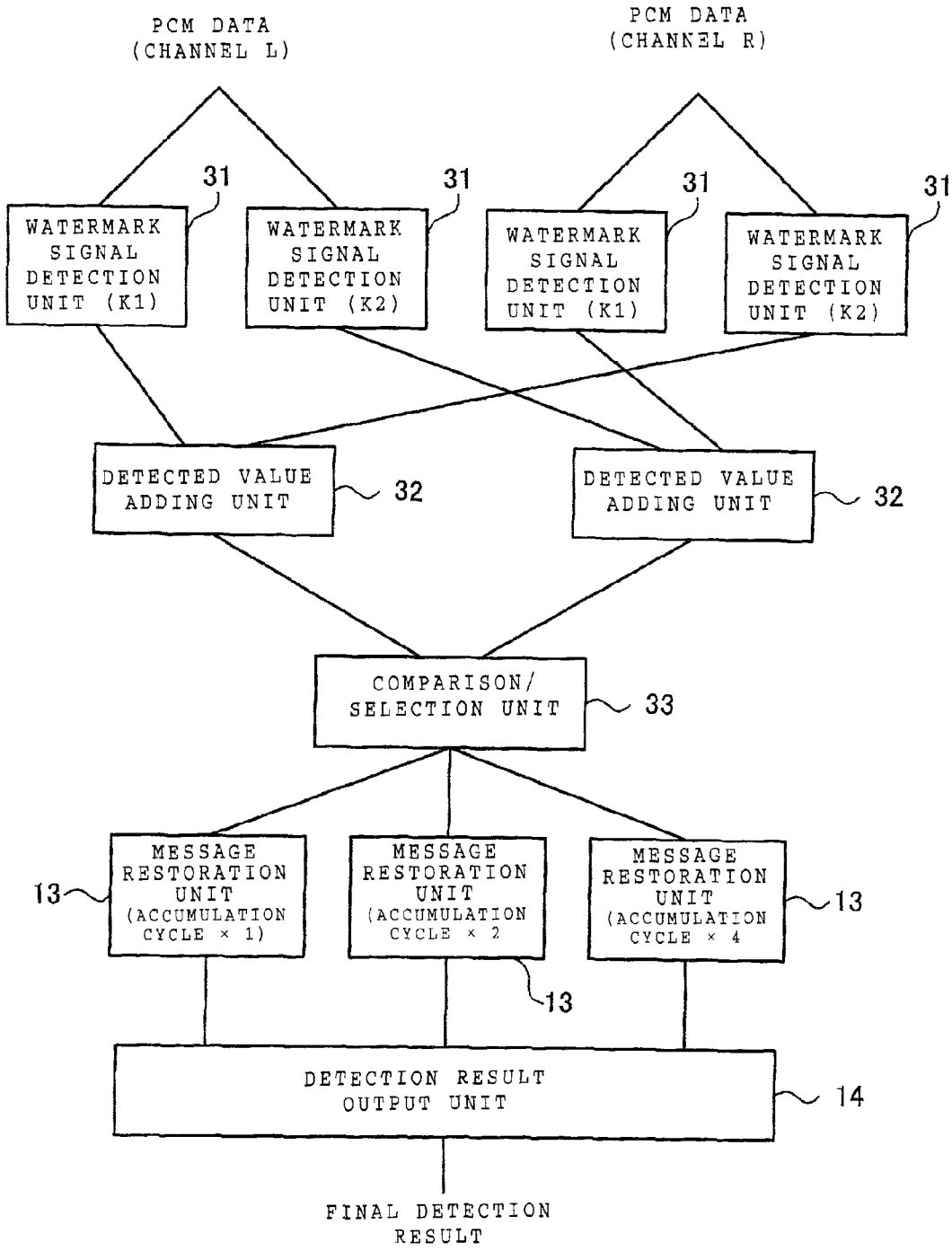
FIG. 11 is a view showing a configuration example of a digital watermark detection apparatus formed by combining the respective configurations of the digital watermark detection apparatuses of Embodiments 1 and 2.

FIG. 11 is a view showing a configuration example of a digital watermark detection apparatus formed by combining the configuration of the digital watermark detection apparatus 10 of Embodiment 1 and the configuration of the digital watermark detection apparatus 30 shown in FIG. 8 in Embodiment 2. As shown in FIG. 11, this digital watermark detection apparatus includes: watermark signal detection units 31 which detect the watermark signals by use of the pseudo random number sequence generated from the data of the respective channels of the audio contents by a plurality of keys; detected value adding units 32 which add together the detected values of the watermark signals detected by the watermark signal detection units 31; and a comparison/selection unit 33. Moreover, the digital watermark detection apparatus includes: a plurality of message restoration units 13 which accumulate the best detected values selected by the comparison/selection unit 33 in a plurality of accumulation cycles and restore the messages from the accumulated watermark signals; and a detection result output unit 14 which performs comparison processing for restoration results by the respective message restoration unit 13 and outputs the comparison result as a final detection result.

Note that the watermark signal detection units 31, the detected value adding units 32 and the comparison/selection unit 33 are similar to the watermark signal detection units 31, the detected value adding units 32 and the comparison/selection unit 33, which are described in Embodiment 2, and the message restoration units 13 and the detection result output unit 14 are similar to the message restoration units 13 and the detection result output unit 14, which are described in Embodiment 1. Hence, the same reference numerals are added to these components, and detailed description thereof is omitted.

In the digital watermark detection apparatus of FIG. 11 also, as in the configuration example shown in FIG. 10, a configuration can be adopted, in which the best restoration result is selected and outputted after restoring the messages.

Figure 12:
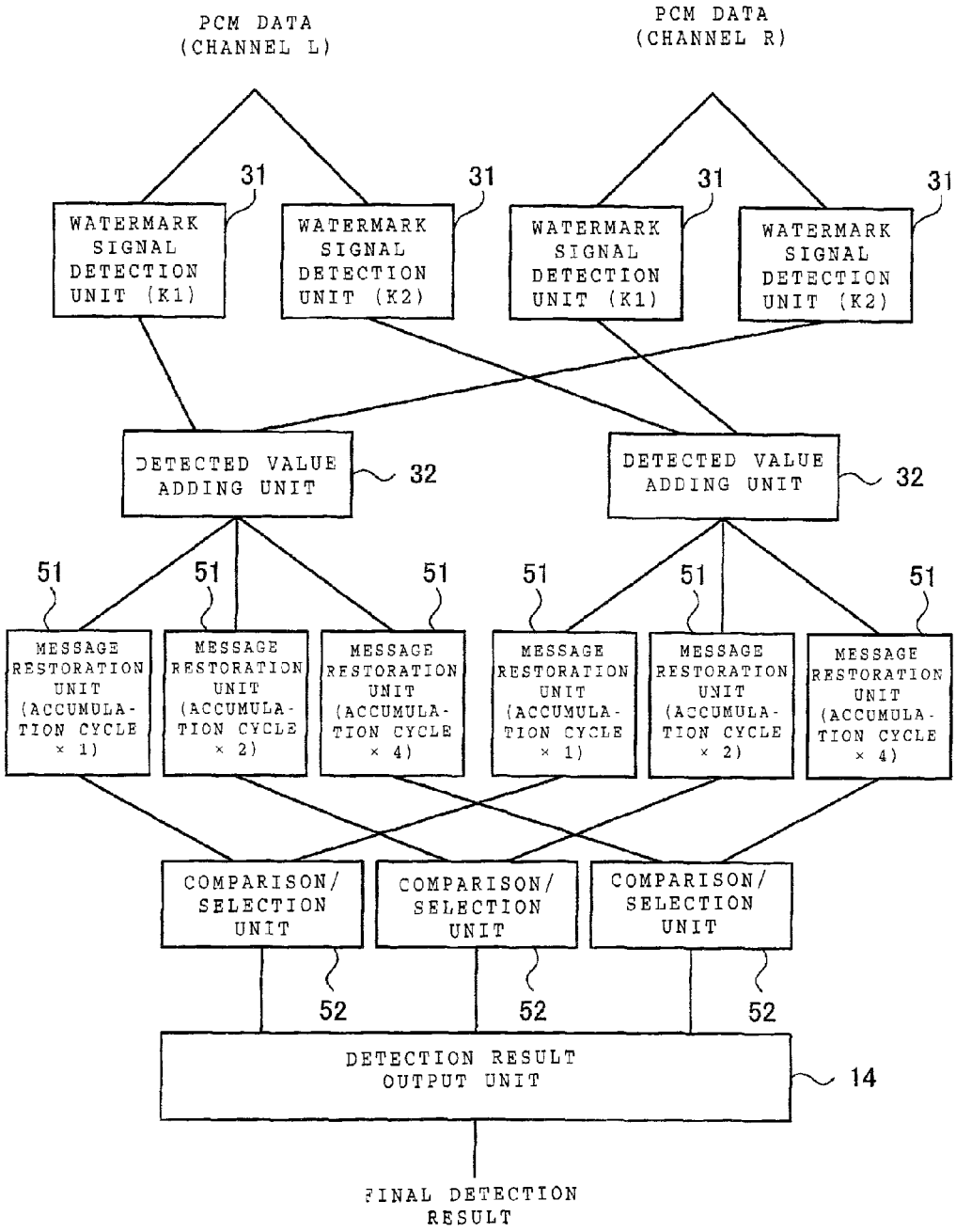
FIG. 12 is a view showing a functional configuration in a case of combining the respective configurations of the digital watermark detection apparatuses of Embodiments 1 and 2 and selecting and outputting the best restoration result after restoring the messages.

FIG. 12 is a view showing a functional configuration in the case of combining the configuration of the digital watermark detection apparatus 10 of Embodiment 1 and the configuration of the digital watermark detection apparatus 30 shown in FIG. 8 in Embodiment 2 and selecting and outputting the best restoration result after restoring the messages. In FIG. 12, watermark signal detection units 31 and detected value adding units 32 are similar to the watermark signal detection units 31 and the detected value adding units 32, which are described in Embodiment 2, and a detection result output unit 14 is similar to the detection result output unit 14 described in Embodiment 1. Hence, the same reference numerals are individually added to these components, and detailed description thereof is omitted.

The message restoration units 51 are realized, for example, by the CPU 101 which is shown in FIG. 1 and controlled by a program, and the plurality thereof are provided so as to correspond to the detected value adding units 32 and in a similar way to the message restoration units 13 shown in FIG. 2 in Embodiment 1. Specifically, in the example of FIG. 12, three types of message restoration units 51 which have a reference accumulation cycle, an accumulation cycle twice as much as the reference and an accumulation cycle four times as much as the reference are provided for each of the outputs of the respective detected value adding units 32. In total, six message restoration units 51 are provided.

Comparison/selection units 52 are realized, for example, by the CPU 101 which is shown in FIG. 1 and controlled by a program, and the plurality thereof are provided so as to correspond to the accumulation cycles of the message restoration units 51, which are different from one another. Then, for each of the accumulation cycles, the comparison/selection units 52 receive and compare the restoration results of the messages by the plurality of message restoration units 51, and select and output series of appropriate messages. The outputs of the respective comparison/selection units 52 are individually inputted to the detection result output unit 14 and compared and integrated with one another, and a final detection result is created based on rules similar to Rules 1 to 3 described in Embodiment 1.

Although the preferred embodiments of the present invention have been described in detail, it should be understood that various changes, substitutions and alternations can be made therein without departing from spirit and scope of the inventions as defined by the appended claims.

Variations described for the present invention can be realized in any combination desirable for each particular application. Thus particular limitations, and/or embodiment enhancements described herein, which may have particular advantages to a particular application need not be used for all applications. Also, not all limitations need be implemented in methods, systems and/or apparatus including one or more concepts of the present invention.

The present invention can be realized in hardware, software, or a combination of hardware and software. A visualization tool according to the present invention can be realized in a centralized fashion in one computer system, or in a distributed fashion where different elements are spread across-several interconnected computer systems. Any kind of computer system—or other apparatus adapted for carrying out the methods and/or functions described herein—is suitable. A typical combination of hardware and software could be a general purpose computer system with a computer program that, when being loaded and executed, controls the computer system such that it carries out the methods described herein. The present invention can also be embedded in a computer program product, which comprises all the features enabling the implementation of the methods described herein, and which—when loaded in a computer system—is able to carry out these methods.

Computer program means or computer program in the present context include any expression, in any language, code or notation, of a set of instructions intended to cause a system having an information processing capability to perform a particular function either directly or after conversion to another language, code or notation, and/or reproduction in a different material form.

Thus the invention includes an article of manufacture which comprises a computer usable medium having computer readable program code means embodied therein for causing a function described above. The computer readable program code means in the article of manufacture comprises computer readable program code means for causing a computer to effect the steps of a method of this invention. Similarly, the present invention may be implemented as a computer program product comprising a computer usable medium having computer readable program code means embodied therein for causing a function described above. The computer readable program code means in the computer program product comprising computer readable program code means for causing a computer to effect one or more functions of this invention. Furthermore, the present invention may be implemented as a program storage device readable by machine, tangibly embodying a program of instructions executable by the machine to perform method steps for causing one or more functions of this invention.

It is noted that the foregoing has outlined some of the more pertinent aspects and embodiments of the present invention. This invention may be used for many applications. Thus, although the description is made for particular arrangements and methods, the intent and concept of the invention is suitable and applicable to other arrangements and applications. It will be clear to those skilled in the art that modifications to the disclosed embodiments can be effected without departing from the spirit and scope of the invention. The described embodiments ought to be construed to be merely illustrative of some of the more prominent features and applications of the invention. Other beneficial results can be realized by applying the disclosed invention in a different manner or modifying the invention in ways known to those familiar with the art.

What is claimed is:

1. A digital watermark detection method for detecting a digital watermark embedded in audio contents by a computer, the method comprising:

causing the computer to calculate a detected value which is a correlation coefficient between a frequency component of pulse code modulation data of the audio contents and a pseudo random number sequence generated by a key used to embed the digital watermark;

storing the detected value in storage;

causing the computer to accumulate the calculated detected value in accumulation cycles different from one another, restoring a message embedded as the digital watermark from the accumulated detected values, detecting the audio contents in which the digital watermark is embedded, and storing results of the detection in the storage;

causing the computer to receive the results of the detection based on the plurality of accumulation cycles, synthesizing detection results of the audio contents in the respective processing results, with the digital watermarks being embedded in the audio content; and outputting the synthesized results.

2. The digital watermark detection method according to claim 1, wherein, when the audio contents in which the digital watermark is embedded are detected by the detection using any of the accumulation cycles, it is determined that the detected audio contents are where the digital watermark is embedded, and it is determined that a portion where the audio contents in which the digital watermark is embedded are not detected by the detection using any of the accumulation cycles is audio contents in which the digital watermark is not embedded.

3. The digital watermark detection method according to claim 1, wherein, when the audio contents in which the digital watermarks are embedded are detected by the detections using the plurality of accumulation cycles different from one another detection result in the detection using a shorter accumulation cycle is prioritized.

4. The digital watermark detection method according to claim 1, wherein, when the audio contents in which the digital watermark is embedded are detected by detection using a predetermined accumulation cycle, a detection result in the accumulation cycle is outputted without waiting for results of detections using other accumulation cycles longer than the accumulation cycle.

5. An article of manufacture comprising a computer usable medium having computer readable program code means embodied therein for causing watermark detection, the computer readable program code means in said article of manufacture comprising computer readable program code means for causing a computer to effect the steps of claim 1.

6. A digital watermark detection method comprising steps of:

using a computer for detecting a plurality of digital watermarks that have been generated by multiple keys and which are embedded in respective channels of audio data, the step of detecting comprising:

a first phase of individually calculating, for pulse code modulation data in respective multi-channels of the audio content, detected values which are correlation coefficients between frequency components of the pulse code modulation data and pseudo random number sequences generated by a plurality of keys used to embed the digital watermark, and to store the calculated detected values in storage;

a second phase of adding the calculated detected values corresponding to the correlation between frequency components of the pulse code modulated data and the pseudo random number sequences of respective multi-channels and the respective plurality of keys for each possible combination of the respective multi-channels and the respective plurality of keys, and to store the added detected values in the storage;

a third phase of receiving the respective results of the addition for each combination of the respective multi-channels and the respective plurality of keys;

comparing the respective results of the addition for each combination of the respective multi-channels and the respective plurality of keys, selecting one result of the addition from among the respective results;

outputting the one result of the addition; and a fourth phase of restoring a message embedded as the digital watermark based on the selected and outputted result of the addition of the detected values, and to detect the audio contents in which the digital watermark is embedded, wherein, in the third phase, an added result in which a sum of absolute values of the detected values is a maximum in the received results of the addition for each possible combination of the respective multi-channels and the respective plurality of keys is selected and outputted, wherein, in the third phase, an added result in which a sum of squares of the detected values is maximum in the received results of the addition for each possible combination of the respective multi-channels and the respective plurality of keys is selected and outputted, wherein, in the third phase, error correction is performed for the received results of the addition for each possible combination of the respective multi-channels and the respective plurality of keys, and one in which the number of bits, an error has occurred therein, is minimum is selected and outputted, wherein, in the third phase, error correction is performed for the received results of the addition for each possible combination of the respective multi-channels and the respective plurality of keys, correct symbols of individual bits are obtained to calculate signal-to-noise ratios, and one in which the obtained signal-to-noise ratio is maximum and is selected and outputted.

7. A digital watermark detection apparatus for detecting a digital watermark embedded in audio content, said apparatus comprising:

a plurality of watermark signal detection units for individually calculating, for pulse code modulation data in respective channels of audio content, detected values which are correlation coefficients between frequency components of the pulse code modulation data and pseudorandom number sequences generated by a plurality of keys used to embed the digital watermark;

a plurality of detected value adding units for adding the detected values calculated by the plurality of watermark signal detection units and corresponding to the respective channels and the respective keys for each possible combination of the respective channels and the respective keys;

a comparison/selection unit for receiving and comparing the respective results of the addition by the plurality of detected value adding units with one another, and selecting and outputting one result of the addition; and a message restoration unit for restoring a message embedded as a digital watermark based on the result of the addition of the detected values, the result being outputted from the comparison/selection unit, and detecting the audio contents in which the digital watermark is embedded.

8. The digital watermark detection apparatus according to claim 7, wherein, in the plurality of detected value adding units, a detected value adding unit for outputting the detected value calculated by one of the watermark signal detection units as is, without adding the detected value to detected values calculated by the other watermark signal detection units, is included.

9. The digital watermark detection apparatus according to claim 7, wherein the comparison/selection unit selects and outputs one in which a sum of absolute values of the detected values is maximum in the received results of the addition by the plurality of detected value adding units.

10. The digital watermark detection apparatus according to claim 7, wherein the comparison/selection unit selects and outputs one in which a sum of squares of the detected values is maximum in the received results of the addition by the plurality of detected value adding units.

11. The digital watermark detection apparatus according to claim 7, wherein the comparison/selection unit performs error correction for the received results of the addition by the plurality of detected value adding units, and selects and outputs one in which the number of bits, an error has occurred therein, is minimum.

12. The digital watermark detection apparatus according to claim 7, wherein the comparison/selection unit performs error correction for the received results of the addition by the plurality of detected value adding units, obtains correct symbols of individual bits to calculate signal-to-noise ratios (SNRs), and selects and outputs one in which the obtained SNR is maximum.

13. The digital watermark detection apparatus according to claim 7, wherein the message restoration unit is a plurality of message restoration units for accumulating the detected values outputted from the comparison/selection unit in accumulation cycles different from one another, restoring the messages embedded as the digital watermarks from the respective accumulated detected values, and detecting the audio contents in which the digital watermarks are embedded, and the digital watermark detection apparatus further comprises a detection result output unit for receiving the respective processing results by the plurality of message restoration units, and synthesizing and outputting detection results from the respective processing results, for the audio contents with the digital watermarks being embedded in the audio content.

14. A digital watermark detection apparatus for detecting a digital watermark embedded in audio content, comprising:

a processor device for executing instructions; and memory storing the instructions as:

a plurality of watermark signal detection units for individually calculating, for pulse code modulation data in the respective channels of audio content, detected values which are correlation coefficients between frequency components of the pulse code modulation data and pseudorandom number sequences generated by a plurality of keys used to embed the digital watermark;

a plurality of detected value adding units for adding the detected values calculated by the plurality of watermark signal detection units and corresponding to the respective channels and the respective keys for each possible combination of the respective channels and the respective keys;

a plurality of message restoration units for individually receiving results of the addition by the plurality of detected value adding units, and restoring messages embedded as the digital watermarks; and a comparison/selection unit which receives and compares results of restoring the messages by the plurality of message restoration units, and selecting and outputting a series of messages.

15. A digital watermark detection apparatus for detecting a digital watermark embedded in audio content, comprising:

a processor device for executing instructions; and memory storing the instructions as:

a watermark signal detection unit for calculating a detected value which is a correlation coefficient between a frequency component of PCM data of the audio contents and a pseudo random number sequence generated by a key used to embed the digital watermark;

a plurality of message restoration units for accumulating the detected value calculated by the watermark signal detection unit in accumulation cycles different from one another, restoring the message embedded as the digital watermark from the accumulated detected values, and detecting the audio contents in which the digital watermark is embedded; and a detection result output unit for receiving the respective processing results by the plurality of message restoration units, and synthesizing and outputting detection results of the audio contents in the respective processing results, with the digital watermarks being embedded in the audio content.

16. The digital watermark detection apparatus according to claim 15, wherein, when the audio contents in which the digital watermark is embedded are detected by any of the message restoration units, the detection result output unit determines that the detected audio contents are the one in which the digital watermark is embedded, and determines a portion where the audio contents in which the digital watermark is embedded are not detected by any of the message restoration units as audio contents in which the digital watermark is not embedded.

17. The digital watermark detection apparatus according to claim 15, wherein, when the audio contents in which the digital watermarks are embedded are detected by the plurality of message restoration units, the detection result output unit prioritizes a detection result by the message restoration unit of which accumulation cycle is shorter.

18. The digital watermark detection apparatus according to claim 15, wherein, when the audio contents in which the digital watermark is embedded is detected by a predetermined one of the message restoration units, the detection result output unit outputs a detection result by the message restoration unit without waiting for detections by the other message restoration units of which accumulation cycles are longer than that of the message restoration unit.

* * * * *